US011640734B2

(12) United States Patent
Wennerblom

(10) Patent No.: US 11,640,734 B2
(45) Date of Patent: May 2, 2023

(54) APPARATUS, SYSTEM AND METHOD FOR CONTROLLING IGNITION OF A VEHICLE

(71) Applicant: STONERIDGE ELECTRONICS AB, Solna (SE)

(72) Inventor: Martin Wennerblom, Bromma (SE)

(73) Assignee: STONERIDGE ELECTRONICS AB, Solna (SE)

( * ) Notice: Subject to any disclaimer, the term of this patent is extended or adjusted under 35 U.S.C. 154(b) by 247 days.

(21) Appl. No.: 16/627,067

(22) PCT Filed: Jun. 27, 2018

(86) PCT No.: PCT/SE2018/050693

§ 371 (c)(1),
(2) Date: Dec. 27, 2019

(87) PCT Pub. No.: WO2019/004914

PCT Pub. Date: Jan. 3, 2019

(65) Prior Publication Data

US 2020/0126332 A1 Apr. 23, 2020

(30) Foreign Application Priority Data

Jun. 28, 2017 (SE) ..... 1705837-5

(51) Int. Cl.
*G07C 9/00* (2020.01)
*G07C 5/08* (2006.01)

(52) U.S. Cl.
CPC ..... *G07C 9/00309* (2013.01); *G07C 9/00571* (2013.01); *G07C 5/085* (2013.01); *G07C 2009/00301* (2013.01); *G07C 2009/00547* (2013.01)

(58) Field of Classification Search
None
See application file for complete search history.

(56) References Cited

U.S. PATENT DOCUMENTS 4,240,516 A 12/1980 Henderson et al.
5,479,156 A * 12/1995 Jones ..... B60R 25/1003 340/12.5
2004/0233046 A1 11/2004 Gotfried et al.
(Continued)

FOREIGN PATENT DOCUMENTS

CA 2778543 12/2012
EP 0785533 7/1997
(Continued)

*Primary Examiner* — Carlos Garcia
(74) *Attorney, Agent, or Firm* — Duane Morris LLP; Gregory M. Lefkowitz; Randall C. Pyles

(57) ABSTRACT

An ignition control apparatus (10) for controlling ignition of a vehicle (270) equipped with a vehicle unit (1) comprising a display (3) and at least one port (5, 5') adapted to receive a user data device (7, 7'), wherein the ignition control apparatus (10) is adapted to be connected to the vehicle unit (1) and to an ignition circuit (20) of the vehicle (270), wherein the ignition control apparatus (10) comprises means (11) for activating and deactivating the ignition circuit (20), depending on insertion of a user data device (7, 7') into the port (5, 5') and/or reception of an override signal (O). Further, a corresponding method, system and use thereof to control ignition of a vehicle (270) is disclosed.

17 Claims, 5 Drawing Sheets

(56) References Cited

U.S. PATENT DOCUMENTS

| | | | | |
|---|---|---|---|---|
| 2005/0179322 | A1* | 8/2005 | Flick | B60R 25/04 307/10.6 |
| 2007/0168125 | A1* | 7/2007 | Petrik | B60R 16/0231 701/469 |
| 2017/0346942 | A1* | 11/2017 | Livingston | H04M 1/72463 |
| 2018/0347532 | A1* | 12/2018 | Tamane | G07C 5/008 |

FOREIGN PATENT DOCUMENTS

| | | |
|---|---|---|
| GB | 2252847 | 8/1992 |
| JP | 2005170162 | 6/2005 |

* cited by examiner

APPARATUS, SYSTEM AND METHOD FOR CONTROLLING IGNITION OF A VEHICLE

CROSS-REFERENCE TO RELATED APPLICATIONS

This application claims priority to European Patent Application No. PCT/SE2018/050693, filed Jun. 27, 2018, which claims priority to Swedish Patent Application No. 1750837-5, filed on Jun. 28, 2017, the entire contents of which are incorporated herein by reference.

TECHNICAL FIELD

The present invention relates generally to an apparatus and method for controlling ignition of a vehicle, and more specifically a vehicle equipped with a vehicle unit such as a digital tachograph.

BACKGROUND ART

Today, transportation by vehicle requires measurement of parameters and information relating to the driver activities. This is not exclusively done to satisfy regulations regarding road transportation, but also for fleet management to measure and increase performance and efficiency, as well as for the purpose of electronic road tolling, monitoring vehicle or engine performance parameters, monitoring data relevant for special transports e.g. dangerous goods, livestock or refrigerated food etc. Therefore, most vehicles, such as lorry trucks, carry a vehicle unit to measure, store and possible also report the collected data. In this document, the term "vehicle unit" shall mean a digital unit capable of gathering information relating to the vehicle. Examples of such information may be a geographical location, driving hours, distance travelled, start time, finish time, rest time, driver name, starting location and finishing location, exhaust measurements, fuel consumption, temperature data from vehicle or cargo sensors, opening and closing of cargo doors or operation of other vehicle systems, e.g. cranes and lifts etc. One example of a vehicle unit is a digital tachograph, capable of recording and digitally compiling and storing the vehicle data.

The vehicle unit is normally located in the cabin of the vehicle, where the vehicle unit is arranged in the instrument board, so that the vehicle operator may operate the vehicle unit in adjacency to start or stop of a journey. In order to calculate and estimate the speed and the travel distance, or other parameters for instance as listed above, of the vehicle, the vehicle unit is in connectivity to one or more sensors, where the sensors are capable of measuring for instance the motion of the wheels or other parameters.

Legislation stipulates that the vehicle operator, i.e. the driver, owns a driver card which must be inserted into the vehicle unit in order to record his/her activities during operation of the vehicle. Heavy fines are imposed on violations against this legislation to ensure that the vehicle operator does not operate the vehicle without inserting the driver card into the vehicle unit. Still, there is a high number of infractions which result in considerable negative economic consequences for fleet owners.

Several technical solutions have been proposed to counteract driving without a driver card inserted into the vehicle unit. For instance, EP 0 785 533 discloses a method for monitoring driving time wherein in case of rest time falling below the stipulated period, it is impossible to start the vehicle. This necessitates insertion of the driver card into the vehicle unit to calculate the actual rest time.

US 2007/0168125 discloses a method and system which, provides real time GPS based vehicle monitoring, management, and cruise control by a small, single, sealed, the in-vehicle monitoring unit, incorporating intelligent speed adaptation, recording driver and vehicle operating parameters in memory and on a smartcard a SATELITE/GPRS/GSM/BLUETOOTH mobile communication facility under the control of a national Transport Management Command Centre. The monitoring unit is supplied with an upgradeable software program which, enables and disables engine ignition on the insertion and the removal of a valid driver card.

GB 2 252 847 discloses an electronic engine management system comprising a first microprocessor for controlling engine function, and a removable token such as a contactless smart card having an electronic memory element included therein and optionally a further microprocessor. Interface means is provided between the token memory and the first microprocessor which may comprise a further microprocessor. At least part of the information required by the first microprocessor (e.g. programming or data) for controlling engine function is held in the token memory. Therefore, the vehicle cannot be operated without the token, even if the token reader is short-circuited.

JP 2005-170162 discloses a vehicular anti-theft device comprising an IC card reading device and an emergency function establishment input device. Individual identifying information recorded in an IC card type driver's license inserted in the IC card reading device is collated with that of a registered user to permit driving. The registered user may establish an emergency mode to enable an unspecified third person to operate the vehicle temporarily during a specified period. However, the IC card type driver's license needs to be inserted in the IC card reading device in order to establish the emergency mode.

However, situations could arise where a vehicle operator needs to start the vehicle without being in possession of his or her driver card. In such cases, the solutions presented in the above-mentioned prior art are impractical, if not unworkable.

Hence, there is a need to develop improved solutions for controlling ignition of vehicles having a vehicle unit installed without impeding or blocking operation of the vehicle in emergency situations.

SUMMARY OF INVENTION

An object of the present invention is to provide improved solutions for controlling ignition of vehicles having a vehicle unit installed without impeding or blocking operation of the vehicle in emergency situations. This object is achieved in a first aspect, by means of an ignition control apparatus for controlling ignition of a vehicle equipped with a vehicle unit comprising a display and at least one port adapted to receive a user data device, wherein the ignition control apparatus is adapted to be connected to the vehicle unit and to an ignition circuit of the vehicle, wherein the ignition control apparatus comprises means for activating and deactivating the ignition circuit, wherein the ignition control apparatus is arranged to receive a data signal from the vehicle unit comprising information about activities being detected by the vehicle unit and indicating whether a user data device is inserted into the port, wherein the ignition control apparatus is arranged to activate the ignition circuit to allow ignition of the vehicle if the data signal indicates that a user data device is inserted into the port and to deactivate the ignition circuit to prevent ignition of the vehicle if the data signal indicates that a user data device is not inserted into the port. If the data signal indicates that a user data device is not inserted into the port, the ignition control apparatus is further arranged to receive an override signal and to activate the ignition circuit to allow ignition of the vehicle in response to receiving the override signal.

By providing an override signal to be transmitted and received by the ignition control apparatus, activation of the ignition circuit in the absence of a user data device is achieved. Preferably, the provision of the override signal should require an effort which is sufficiently cumbersome and inconvenient so as to deter users with user data devices from overriding the ignition control, yet not so complicated and protracted that ignition is hindered or prevented in the case of an emergency.

In a preferred embodiment, the ignition control apparatus comprises a microprocessor arranged to read data signals from the vehicle unit and to control the means for activating and deactivating the ignition circuit. The microprocessor provides the necessary functionality for controlling the components of the ignition control apparatus in a compact format which facilitates installation and retrofitting into existing vehicles.

In an advantageous embodiment, the data signal is transmitted and received in serial communication over a vehicle bus network, including a Controller Area Network (CAN) bus or a Local Interconnect Network (LIN) bus, and/or a wireless network connection, including Bluetooth®, and the data signal comprises serial data. By using pre-existing in-vehicle communication infrastructure and protocols, installation and retrofitting is facilitated.

In a further preferred embodiment, the means for activating and deactivating the ignition circuit comprises an electronic switch. Preferably, the electronic switch comprises one or more of a relay, a transmission gate, an analogue switch, and/or a number of MOSFET transistors. The electromechanical components for making and breaking (switching) circuits are robust and simple which reduces the cost for manufacture.

In an alternative embodiment, the means for activating and deactivating the ignition circuit comprises means for sending an activation signal to a control unit of the ignition circuit to allow ignition of the vehicle. Such a solution allows for a simplified installation where a physical connection between the ignition control apparatus and the ignition circuit of the vehicle may not be required.

In a preferred embodiment, the override signal is comprised in the data signal from the vehicle unit to the ignition control apparatus and comprises a sequence of activities being detected by the vehicle unit. The sequence of activities detected by the vehicle unit may be initiated or caused by the user, such that the override signal may be generated in a simple manner, yet requiring a certain amount of time and effort from the user.

In an advantageous embodiment, the ignition control apparatus comprises means for communicating with an external server comprising a database containing data relating to authorised user data devices, wherein the ignition control apparatus is arranged to verify whether the user data device inserted into the port of the vehicle unit is authorised and to activate the ignition circuit to allow ignition of the vehicle only if an authorised user data device is inserted into the port of the vehicle unit. The verification of inserted user data devices provides an additional layer of security in that only authorised cards may be used to start the vehicle.

Preferably, the data relating to authorised user data devices comprises an identifier and one or more of a time interval, route details, a list of locations and type of vehicle associated with a user data device, wherein the verification of the user data device inserted into the port of the vehicle unit comprises comparing the data associated with the inserted user data device obtained from the external database and corresponding data obtained from the vehicle unit. The data used for verification may be tailored at an individual or group level to effectively control which users are authorised to start a chosen vehicle under which conditions.

In a further preferred embodiment, the ignition control apparatus further comprises means for communicating with an external server, wherein the override signal is received from the external server. By transmitting and receiving the override signal from an external server, an additional layer of security is provided in that access to and/or communication with an external server is required.

In an advantageous embodiment, the override signal received from the external server defines a predetermined sequence of activities to be detected by the vehicle unit, and wherein the ignition control apparatus is configured to verify that the sequence of activities detected by the vehicle unit corresponds to the predetermined sequence of activities to be detected by the vehicle unit defined by the override signal before activating the ignition circuit to allow ignition of the vehicle. This gives the advantage that the sequence of activities to be detected need not be predetermined, but instead transmitted in real time to prevent unauthorised overriding of the ignition.

In an alternative embodiment, the ignition control apparatus is arranged to communicate with an external device, wherein the ignition control apparatus is arranged to activate the ignition circuit to allow ignition of the vehicle in response to receiving an override signal from the external device. The provision of the override signal from an external device provides an additional layer of security in that only users in possession of such an external device may start the vehicle.

In a second aspect of the present invention, there is provided a method performed by a vehicle ignition control system for controlling ignition of a vehicle equipped with a vehicle unit comprising a display and a port adapted to receive a user data device, comprising the steps:

receiving a data signal from the vehicle unit comprising information about activities being detected by the vehicle unit and indicating whether a user data device is inserted into the port;

if the data signal indicates that a user data device is inserted into the port of the vehicle unit, activating an ignition circuit of the vehicle to allow ignition of the vehicle; or if the data signal indicates that a user data device is not inserted into the port of the vehicle unit, deactivating an ignition circuit of the vehicle to prevent ignition of the vehicle, wherein the method further comprises the step:

if the data signal indicates that a user data device is not inserted into the port of the vehicle unit, in response to receiving an override signal, activating an ignition circuit of the vehicle to allow ignition of the vehicle.

By providing an override signal to be transmitted and received by the ignition control apparatus, activation of the ignition circuit in the absence of a user data device is achieved. Preferably, the provision of the override signal should require an effort which is sufficiently cumbersome and inconvenient so as to deter users with user data devices from overriding the ignition control, yet not so complicated and protracted that ignition is hindered or prevented in the case of an emergency.

In a preferred embodiment, the override signal is comprised in the data signal received from the vehicle unit and comprises a predetermined sequence of activities detected by the vehicle unit. The sequence of activities detected by the vehicle unit may be initiated or caused by the user, such that the override signal may be generated in a simple manner, yet requiring a certain amount of time and effort from the user. Preferably, the override signal is received from an external device or external server. By transmitting and receiving the override signal from an external server or external device, an additional layer of security is provided in that access to and/or communication with an external server or external device is required.

In an advantageous embodiment, the method further comprises the steps:

communicating with an external server containing data relating to authorised user data devices;

if the data signal indicates that a user data device is inserted into the port of the vehicle unit, verifying whether the inserted user data is authorised; and activating the ignition circuit to allow ignition of the vehicle only if the inserted user data device is verified to be authorised.

The verification of inserted user data devices provides an additional layer of security in that only authorised cards may be used to start the vehicle.

Preferably, the data relating to authorised user data devices comprises an identifier and one or more of a time interval, route details, a list of locations and type of vehicle associated with a user data device, wherein the step of verification of the inserted user data device comprises comparing data received from the external server associated with the inserted user data device and corresponding data contained in the data signal obtained from the vehicle unit. The data used for verification may be tailored at an individual or group level to effectively control which users are authorised to start a chosen vehicle under which conditions.

In an alternative embodiment, the method further comprises the steps:

transmitting an unlocking signal defining a sequence of activities to be detected by the vehicle unit from the external server to an external device associated with the inserted user data device;

displaying the sequence of activities to be detected by the vehicle unit on the external device; and activating the ignition circuit to allow ignition of the vehicle only if the sequence of activities defined by the transmitted unlocking signal is detected by the vehicle unit.

This gives the advantage that the sequence of activities to be detected need not be predetermined, but instead transmitted and displayed to the user in real time to prevent unauthorised overriding of the ignition.

In a third aspect of the present invention, there is provided a vehicle ignition control system for controlling ignition of a vehicle equipped with a vehicle unit comprising a display and a port adapted to receive a user data device, the system being arranged to:

receive a data signal from the vehicle unit comprising information about activities being detected by the vehicle unit and indicating whether a user data device is inserted into the port by means of a communication unit;

if the data signal indicates that a user data device is inserted into the port of the vehicle unit, activate an ignition circuit of the vehicle to allow ignition of the vehicle by means of an electronic switch; or if the data signal indicates that a user data device is not inserted into the port of the vehicle unit, deactivate an ignition circuit of the vehicle to prevent ignition of the vehicle by means of an electronic switch, wherein the system is further arranged to:

if the data signal indicates that a user data device is not inserted into the port of the vehicle unit, receive an override signal, and in response to activate an ignition circuit of the vehicle to allow ignition of the vehicle by means of an electronic switch.

By providing an override signal to be transmitted and received by the ignition control apparatus, activation of the ignition circuit in the absence of a user data device is achieved. Preferably, the provision of the override signal should require an effort which is sufficiently cumbersome and inconvenient so as to deter users with user data devices from overriding the ignition control, yet not so complicated and protracted that ignition is hindered or prevented in the case of an emergency.

In a preferred embodiment, the override signal is comprised in the data signal received from the vehicle unit and comprises a predetermined sequence of activities detected by the vehicle unit. The sequence of activities detected by the vehicle unit may be initiated or caused by the user, such that the override signal may be generated in a simple manner, yet requiring a certain amount of time and effort from the user. Preferably, the override signal is received from an external device or external server. By transmitting and receiving the override signal from an external server or external device, an additional layer of security is provided in that access to and/or communication with an external server or external device is required.

In an advantageous embodiment, the system is further arranged to:

communicate with an external server comprising a database containing data relating to authorised user data devices by means of a communication unit;

if the data signal indicates that a user data device is inserted into the port of the vehicle unit, verify whether the user data device inserted into the port of the vehicle unit is authorised by means of a processing unit; and activate the ignition circuit to allow ignition of the vehicle by means of an electronic switch only if the inserted user data device is verified to be authorised.

The verification of inserted user data devices provides an additional layer of security in that only authorised cards may be used to start the vehicle.

Preferably, the data relating to authorised user data devices comprises an identifier and one or more of a time interval, route details, a list of locations and type of vehicle associated with a user data device, wherein the verification of the inserted user data device comprises comparing data received from the external server associated with the inserted user data device and corresponding data contained in the data signal obtained from the vehicle unit by means of a processing unit. The data used for verification may be tailored at an individual or group level to effectively control which users are authorised to start a chosen vehicle under which conditions.

In an alternative embodiment, the system is further arranged to:

transmit an unlocking signal defining a sequence of activities to be detected by the vehicle unit from the external server to an external device associated with the inserted user data device by means of a communication unit;

display the sequence of activities to be detected by the vehicle unit on the external device; and activate the ignition circuit to allow ignition of the vehicle by means of the electronic switch only if the sequence of activities defined by the transmitted unlocking signal is detected by the vehicle unit.

This gives the advantage that the sequence of activities to be detected need not be predetermined, but instead transmitted and displayed to the user in real time to prevent unauthorised overriding of the ignition.

In a fourth aspect of the present invention, there is provided use of an ignition control apparatus according to the first aspect or a vehicle ignition control system according to the third aspect to control ignition of a vehicle.

BRIEF DESCRIPTION OF DRAWINGS

The invention is now described, by way of example, with reference to the accompanying drawings, in which.

DESCRIPTION OF EMBODIMENTS

In the following, a detailed description of an apparatus, method, and system for controlling ignition of a vehicle is provided.

Figure 1:
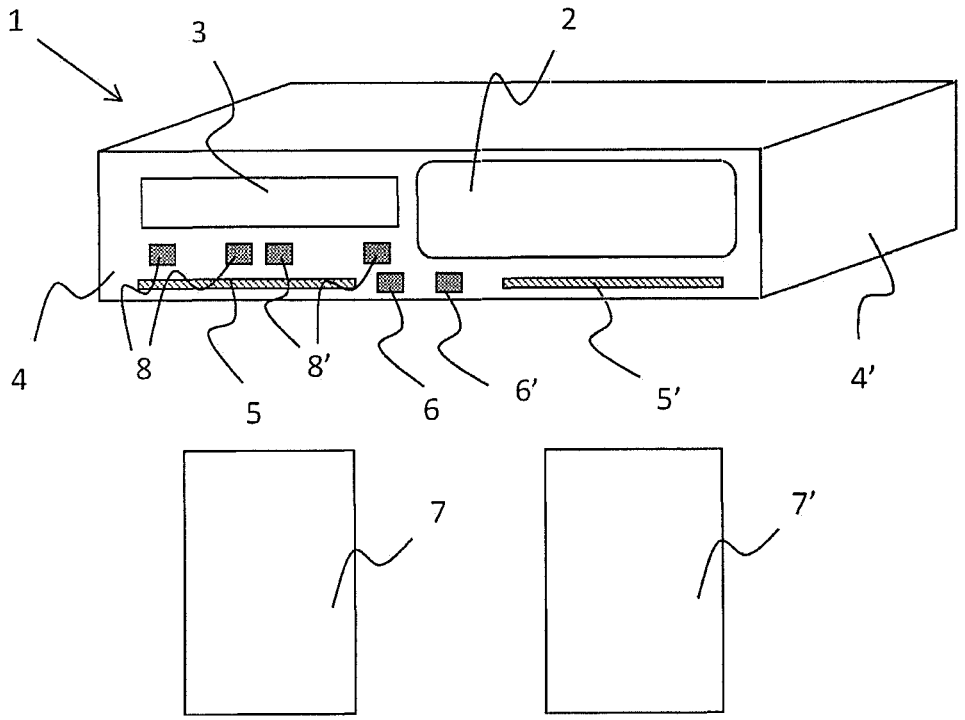
FIG. 1 shows a perspective view of a vehicle unit.

FIG. 1 illustrates a perspective view of a vehicle unit 1, such as a tachograph 1, for measuring, processing, storing or reporting collected vehicle data. The outer design and form factor of the vehicle unit 1 complies with standards in the field of tachographs such as e.g. ISO 7736. The front end 4 of the vehicle unit 1 comprises an access panel 2 being in a closed position, i.e. wherein the access panel is closed, thereby covering a space for housing a printer, preferably a removable printer module. The vehicle unit 1 further comprises a display 3, a first user data device port 5 and a second user data device port 5', and a first side end 4' to disclose the depth of the vehicle unit 1 in a direction perpendicular to the front side 4. According to one embodiment, the user data device ports 5, 5' are card slots adapted to receive user data devices 7, 7' adapted to comprise stored user data. A first user data device 7 and a second user data device 7' are further disclosed in FIG. 1. Eject or release buttons 6, 6' for ejecting/releasing of the respective user data device 7, 7' upon pressing or touching said eject buttons 6, 6' are further shown in FIG. 1. Examples of user data devices 7, 7' to be inserted into the card slots 5, 5' include company cards, workshop cards or driver cards. The user data devices 7, 7' may have different levels of authorisation in order to provide access to the different functions of the vehicle unit 1 as will be explained further below.

The front end 4 also comprises one or more buttons 8, 8' for operating the vehicle unit 1, for instance for inputting information or commands, confirming actions etc. relating to the user data devices 7, 7' inserted into the respective card slots 5, 5'. One action which may be performed is to change the activity that is detected by the vehicle unit 1, e.g. to change which one of the card slots 5, 5' is active when a user data device 7, 7' is inserted in the respective card slots 5, 5'.

Figure 2:
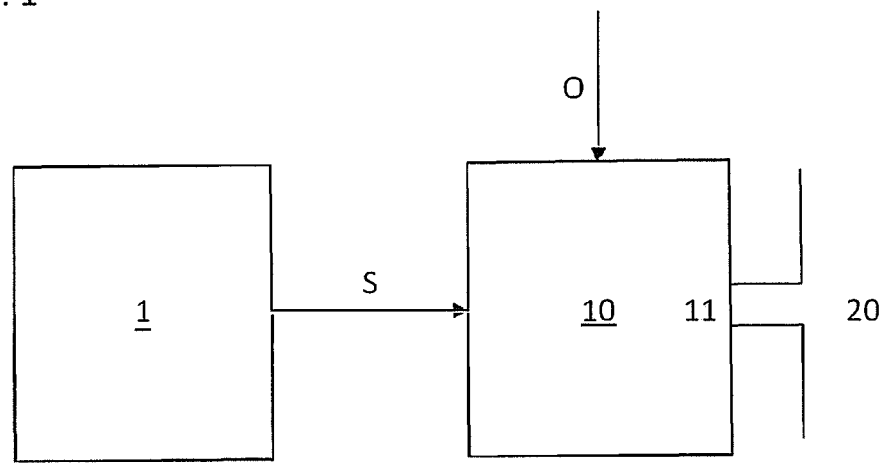
FIG. 2 shows a schematic view of an apparatus according to the present invention connected between a vehicle unit and an ignition circuit of a vehicle.

In FIG. 2, a schematic connection diagram for an ignition control apparatus 10 according to the present invention is shown. The ignition control apparatus 10 is adapted to be connected between the vehicle unit 1 and the ignition circuit 20 of the vehicle 270. The ignition control apparatus 10 comprises means for activating or deactivating the ignition circuit, for instance by means of an electronic switch 11. The electronic switch 11 may comprise a relay, a transmission gate, an analogue switch, and/or a number of MOSFET transistors configured to interrupt the signal from the ignition to the engine starter, i.e. to make or break the connection between the ignition and the starter, thus activating or deactivating the ignition circuit to control starting of the vehicle 270. The ignition circuit 20 is adapted to the vehicle 270 as known in the art, and will therefore not be discussed further in the present disclosure. In FIG. 2, the ignition circuit 20 is located on the right-hand side and here represented only by its connection terminals to the electronic switch 11 of the ignition control apparatus 10. A start signal generated by the driver, e.g. when turning the key of the ignition system in the vehicle 270, is fed to the ignition control apparatus 10. Depending on the state of the electronic switch 11 (activated or deactivated), the start signal will either be interrupted, such that the main electrical systems and engine remain shut off, or relayed to the relevant components of the ignition circuit 20 to turn on the main electrical systems and engine and start the vehicle 270.

In one embodiment of the present invention, the means for activating and deactivating the ignition circuit comprises means for sending an activation signal to a control unit of the ignition circuit 20 to allow ignition of the vehicle 270.

Figure 3:
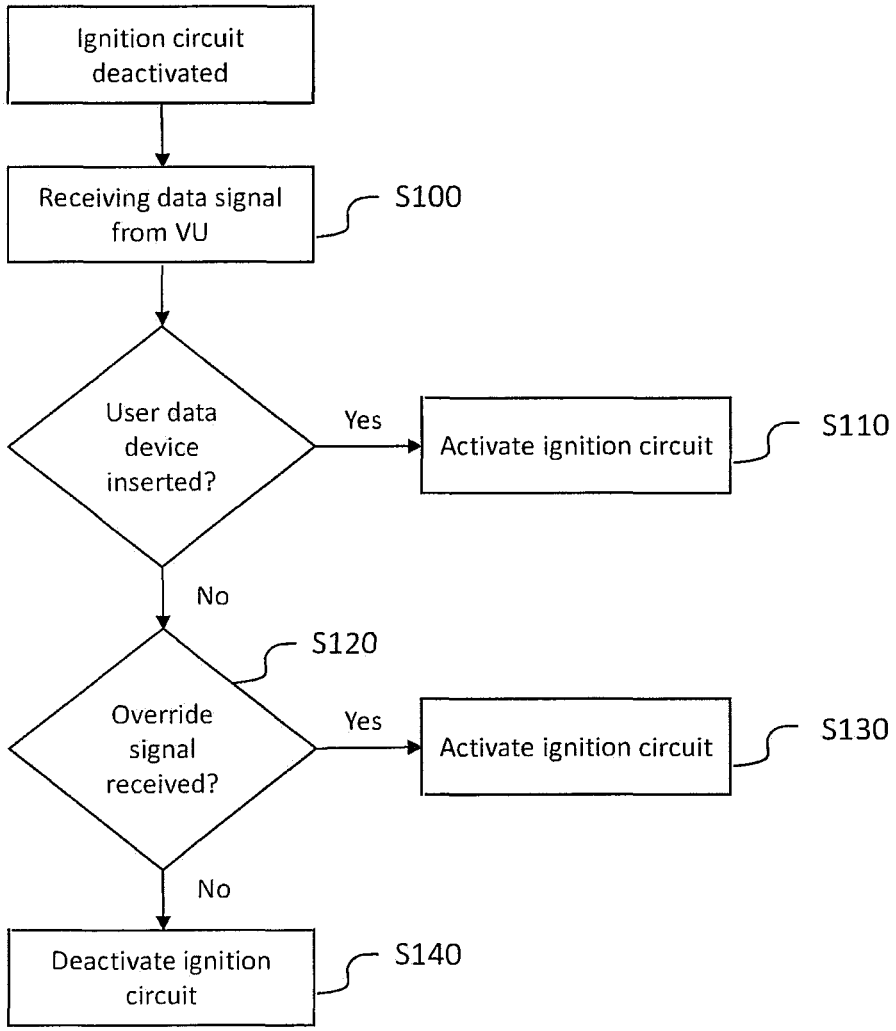
FIG. 3 shows a flow chart of a method of controlling ignition of a vehicle according to the present invention.

Turning now to FIG. 3, a method according to the present invention, which may be performed by the ignition control apparatus 10 or an ignition control system as a whole, is illustrated in the form of a flow chart. Initially, the ignition circuit 20 is deactivated as would normally be the case when a driver enters a vehicle 270. In a first step, a data signal S is received S100 from the vehicle unit 1. The data signal S may be transmitted and received in serial communication over a vehicle bus network, such as a Controller Area Network (CAN) bus or a Local Interconnect Network (LIN) bus or any other suitable cable connection in the vehicle 270. Alternatively, the data signal S may be transmitted and received over a wireless network connection, using protocols such as e.g. Bluetooth®, zigbee, INSTEON, Wireless USB, Z-Wave, IrDA. The data signal S comprises serial data detected, recorded, and/or generated by the vehicle unit 1, such as e.g. geographical location, driving hours, distance travelled, start time, finish time, rest time, driver name, starting location and finishing location, exhaust measurements, fuel consumption, temperature data from vehicle 270 or cargo sensors, opening and closing of cargo doors or operation of other vehicle 270 systems, e.g. cranes and lifts etc. Additionally, the data signal S may include information indicating whether a user data device 7, 7' is inserted into the vehicle unit 1 and data contained on the user data device 7, 7', inherently associated with the user/driver.

Next, the data signal S is read to determine whether a user data device 7, 7' is inserted into one of the ports 5, 5'. If the data signal S indicates that a user data device 7, 7' is indeed inserted into the vehicle unit 1, the ignition circuit 20 is activated S110, i.e. by actuating the electronic switch 11 of the ignition control apparatus 10, such that the vehicle 270 may be started. If, on the other hand, the data signal S indicates that a user data device 7, 7' is not inserted into the vehicle unit 1, the ignition circuit 20 remains deactivated and the vehicle 270 may not be started.

In such a case, a next step comprises receiving S120 an override signal O and in response, activating S130 the ignition circuit 20 to enable starting of the vehicle 270. Again, in the opposite case, if no override signal O is received, the ignition circuit 20 remains deactivated S140.

In one embodiment of the present invention, the override signal O is comprised in the data signal S from the vehicle unit 1 to the ignition control apparatus 10 and comprises a sequence of activities being detected by the vehicle unit 1. Preferably, the sequence of activities is to be detected within a predetermined period of time. Examples of activities includes switching between which one of the card slots 5, 5' is active when a user data device 7, 7' is inserted in the respective card slots 5, 5', out of scope selection, selection of start or end country, printout, or any other interaction with the vehicle unit 1, e.g. by pressing the buttons 8, 8' of the vehicle unit 1 in a predetermined pattern or sequence. In one embodiment, the sequence of activities to be detected by the vehicle unit 1 may be pre-programmed into the ignition control apparatus 10 and displayed in the vehicle 270, e.g. on a sticker or label placed on or near the vehicle unit 1 or other appropriate location in the driver cabin of the vehicle 270.

Alternatively, the override signal O may be received from an external device 400 communicating with the ignition control apparatus 10, e.g. a smartphone, a laptop computer, an electronic control unit (ECU)/dongle having diagnostic functions and/or remote communication capability. The external device 400 may communicate wirelessly with the ignition control apparatus 10 via a communication unit 13 comprised therein. Alternatively, the external device 400 may be plugged into the vehicle unit 1 and communicate with the ignition control apparatus 10 over the vehicle bus network.

Figure 4A:
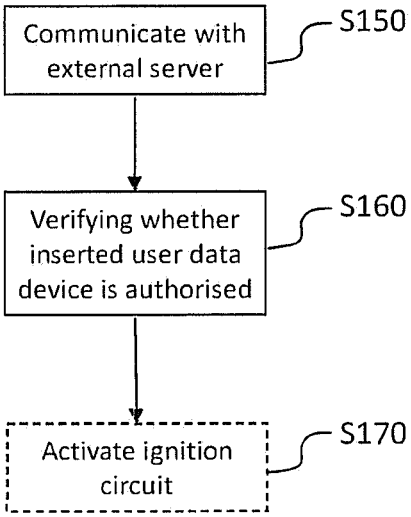
FIGS. 4*a* and 4*b* show further embodiments of the method.

For an added layer of security, in one embodiment of the present invention, the ignition control apparatus 10 is arranged to communicate with an external server 300 in order to activate the ignition circuit 20 of the vehicle 270. The external server 300 may comprise or have access to a database 150 containing data relating to authorised user data devices 7, 7'. FIG. 4*a* illustrates a method according to one embodiment of the invention, wherein a first step comprises communicating S150 with an external server 300 which comprises a database 150 containing data relating to authorised user data devices. If the data signal S indicates that a user data device 7, 7' is inserted into the port 5, 5' of the vehicle unit 1, the next step comprises verifying S160 whether the inserted user data 7, 7' is authorised. Then, only if the inserted user data device 7, 7' is verified to be authorised, the ignition circuit 20 is activated.

In one embodiment of the present invention, the data relating to authorised user data devices comprises an identifier and one or more of a time interval, route details, a list of locations and type of vehicle associated with a user data device, wherein the step of verification of the inserted user data device comprises comparing data received from the external server associated with the inserted user data device and corresponding data contained in the data signal S obtained from the vehicle unit 1. In other words, the external server 300, which may be located at and operated from a remote location by the fleet owner directly or indirectly, has access to a database 150 containing the card information (number, name etc.) for all cards (driver, workshop, company, fleet) that are authorised to be used to operate the vehicles in the fleet owned by the company. Only cards included in the database 150 may then be used to start a vehicle 270 in the fleet.

Figure 4B:
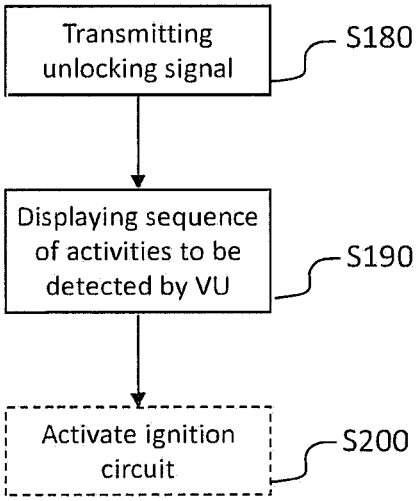

In one further embodiment of the present invention, illustrated in FIG. 4*b*, the method may comprise an initial step of transmitting S180 an unlocking signal defining a sequence of activities to be detected by the vehicle unit 1 from the external server 300 to an external device associated with the inserted user data device 7, 7'. The external device may for instance be a handheld device such as a smartphone or computer. Next, the sequence of activities to be detected by the vehicle unit 1 is displayed S190 on the external device as an instruction for the user. Finally, only if the sequence of activities defined by the transmitted unlocking signal is detected by the vehicle unit 1, the ignition circuit 20 is activated S200. The user may optionally be prompted to cause the vehicle unit 1 to detect the displayed sequence of activities, e.g. by pressing the buttons 8, 8' in a particular order, preferably within a certain (predetermined) period of time.

Figure 5:
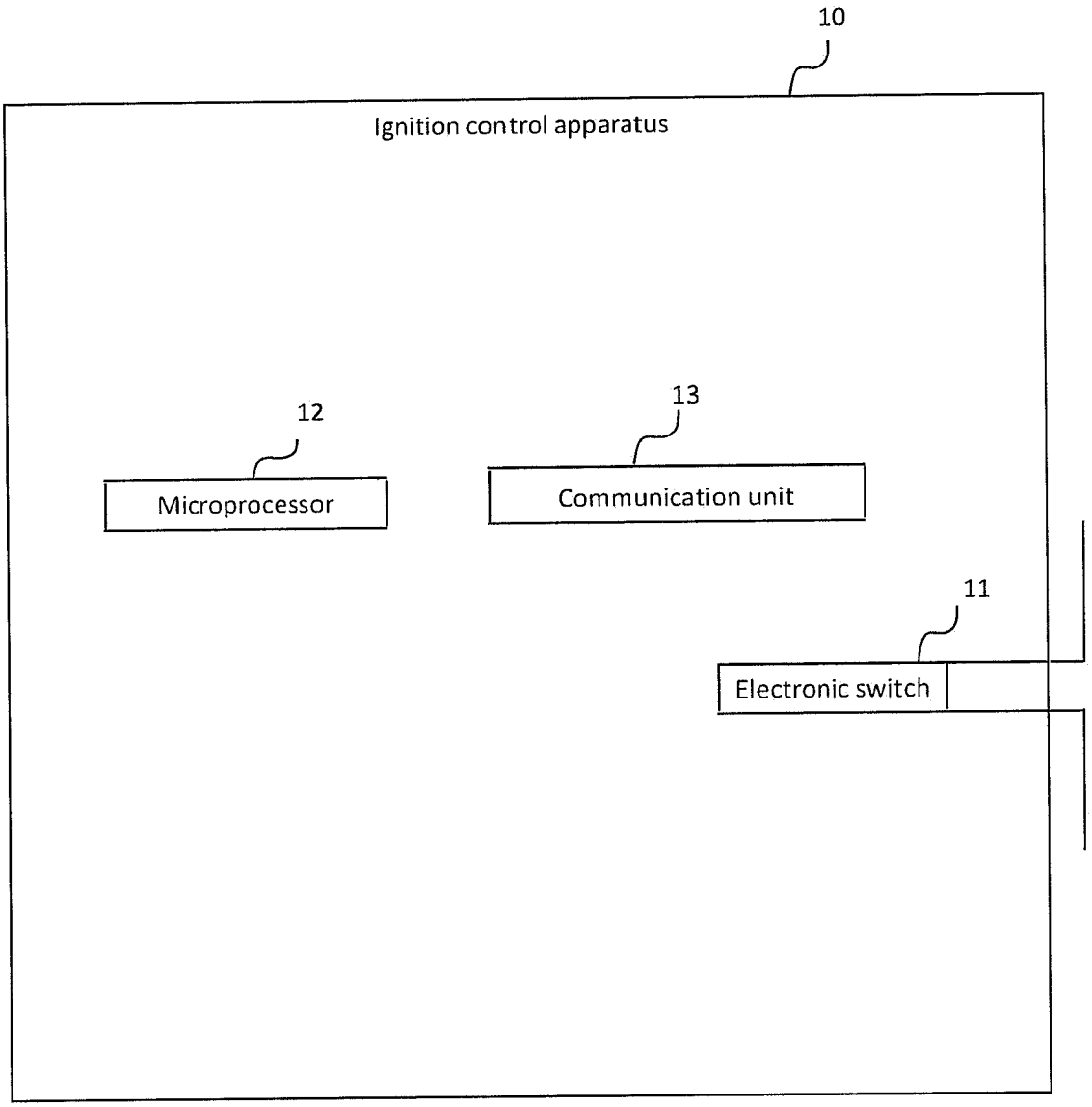
FIG. 5 shows a schematic view of an apparatus according to the present invention.

With reference to FIG. 5, an ignition control apparatus 10 for controlling ignition of a vehicle is disclosed. The ignition control apparatus 10 comprises a microprocessor 12 arranged to read data signals S from the vehicle unit 1 and to control means for activating and deactivating the ignition circuit 20 in the form of an electronic switch 11. As explained above, an override signal O may be received and read by the microprocessor 12 to determine that the electronic switch 11 should be actuated to activate the ignition circuit 20. Additionally, the ignition control apparatus 10 comprises a communication unit 13 arranged to communicate with the vehicle unit 1, for instance over the vehicle bus network, and with the external server 300 or with the external device 400, for instance over a wireless network or connection as will be explained further below.

Figure 6:
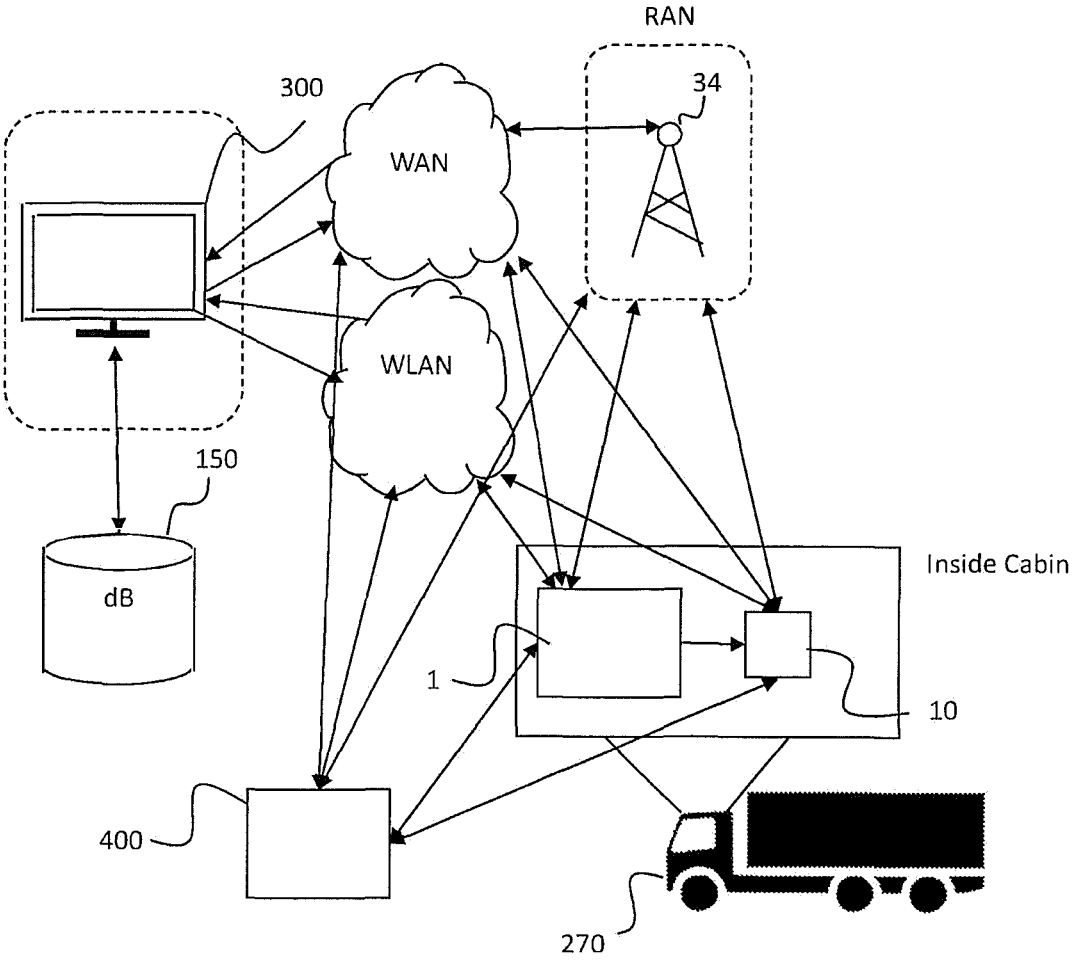
FIG. 6 shows a schematic view of communication

With reference to FIG. 6, a block chart illustrating a signalling scenario involving a vehicle unit 1 and an ignition control apparatus 10 comprised in a vehicle 270. The vehicle unit 1 and/or the ignition control apparatus 10 each comprises means for communicating with external servers or remote nodes 300. According to one embodiment, the vehicle unit 1 and/or the ignition control apparatus 10 may be capable of communicating using a Radio Access Network, RAN, comprising a base station 34. The base station 34 can then communicate, using a Wide Area Network, such as Internet or a private WAN, such as a corporate network, with a remote node 300, e.g. a back-end server, which may comprise a fleet management system as well as a database 150 containing data relating to authorised user data devices, as explained above. The vehicle unit 1 and/or the ignition control apparatus 10 may also be adapted to communicate directly with a remote node 300 using a WAN or in certain situations a Wireless Local Area Network, WLAN. The latter may be preferable in a situation wherein the vehicle 270 comprising the vehicle unit 1 and the ignition control apparatus 10 is located or parked close to and using the WLAN of for instance a home office, goods terminal or at a customs station. Then, the vehicle unit 1 and/or the ignition control apparatus 10 may provide parts, or all, of the information relating to the operation of the vehicle to a remote node 300. The remote node 300, according to one embodiment comprising a fleet management system may then, based on the provided information, help the vehicle operator to make decisions for a more efficient transportation.

Additionally, an external device 400 such as a smartphone, a laptop computer, an electronic control unit (ECU)/dongle having diagnostic functions and/or remote communication capability is illustrated. The external device 400 is configured to communicate using a Radio Access Network, RAN, comprising the base station 34. The base station 34 can then communicate, using a Wide Area Network, such as Internet or a private WAN, such as a corporate network, with the remote node 300, as explained above. The external device 400 may also be adapted to communicate directly with a remote node 300 using a WAN or in certain situations a Wireless Local Area Network, WLAN. As explained above, the external device 400 is arranged to receive an override signal O from the external server 300, which may then be transmitted to the ignition control apparatus 10 to activate the ignition circuit 20. Alternatively, an unlocking signal may be transmitted by the external server 300 to the external device 400, and said unlocking signal defines a certain sequence of activities to be detected by the vehicle unit 1, which is displayed on the external device 400 as an instruction to the user. Examples of activities may be the same as explained above. The user must then cause or initiate this sequence of activities on or in the vehicle unit 1 in order to activate the ignition circuit 20 via the ignition control apparatus 10.

The invention claimed is:

1. An ignition control apparatus, comprising:

a microprocessor arranged to read data signals from a vehicle unit installed in a vehicle in order to control activating and deactivating an ignition circuit of the vehicle, wherein the ignition control apparatus is configured to be retrofitted into the vehicle to control ignition thereof, wherein the vehicle unit is capable of recording, digitally collecting, and storing vehicle data and activities of a user during operation of the vehicle, the vehicle unit comprising a display and at least one card slot adapted to receive a user data device as a card including stored user data associated with the user, wherein the ignition control apparatus is adapted to be connected between the vehicle unit and the ignition circuit of the vehicle, wherein the ignition control apparatus is arranged to receive a data signal from the vehicle unit including information about activities being detected by the vehicle unit and indicating whether the user data device is inserted into the port card slot, wherein the ignition control apparatus is arranged to activate the ignition circuit to allow ignition of the vehicle if the data signal indicates that the user data device is inserted into the card slot and to deactivate the ignition circuit to prevent ignition of the vehicle if the data signal indicates that the user data device is not inserted into the card slot, and wherein if the data signal indicates that the user data device is not inserted into the card slot, the ignition control apparatus is further arranged to receive an override signal and to activate the ignition circuit to allow ignition of the vehicle in response to receiving the override signal.

2. The ignition control apparatus according to claim 1, wherein the data signal is transmitted and received in serial communication over a vehicle bus network, including a Controller Area Network (CAN) bus or a Local Interconnect Network (LIN) bus, and/or a wireless network connection, including Bluetooth®, and wherein the data signal comprises serial data.

3. The ignition control apparatus according to claim 1, wherein the activating and deactivating the ignition circuit comprises an electronic switch.

4. The ignition control apparatus according to claim 3, wherein the electronic switch comprises one or more of a relay, a transmission gate, an analogue switch, and a MOSFET transistor.

5. The ignition control apparatus according to claim 1, wherein the activating and deactivating the ignition circuit comprises generating and sending an activation signal to a control unit of the ignition circuit to allow ignition of the vehicle.

6. The ignition control apparatus according to claim 1, wherein the override signal is in the data signal from the vehicle unit to the ignition control apparatus and comprises a sequence of activities initiated by the user and being detected by the vehicle unit.

7. The ignition control apparatus according to claim 1, wherein the ignition control apparatus comprises circuitry to communicate with an external server comprising a database containing data relating to authorized user data devices, and wherein the ignition control apparatus is arranged to verify whether the user data device inserted into the card slot of the vehicle unit is authorized and to activate the ignition circuit to allow ignition of the vehicle only if an authorized user data device is inserted into the card slot of the vehicle unit.

8. The ignition control apparatus according to claim 7, wherein the data relating to authorized user data devices comprises an identifier and one or more of a time interval, route details, a list of locations, and type of vehicle associated with the user data device, and wherein the verification of the user data device inserted into the card slot of the vehicle unit comprises comparing the data associated with the inserted user data device obtained from the external database and corresponding data obtained from the vehicle unit.

9. The ignition control apparatus according to claim 7, wherein the override signal is received from the external server.

10. The ignition control apparatus according to claim 9, wherein the override signal received from the external server defines a predetermined sequence of activities to be detected by the vehicle unit, and wherein the ignition control apparatus is configured to verify that the sequence of activities detected by the vehicle unit corresponds to the predetermined sequence of activities to be detected by the vehicle unit defined by the override signal before activating the ignition circuit to allow ignition of the vehicle.

11. The ignition control apparatus according to claim 1, wherein the ignition control apparatus is arranged to communicate with an external device, and wherein the ignition control apparatus is arranged to activate the ignition circuit to allow ignition of the vehicle in response to receiving an override signal from the external device.

12. A method performed by an ignition control apparatus for controlling ignition of a vehicle equipped with a vehicle unit, the method comprising the steps:

receiving a data signal from the vehicle unit comprising information about the activities being detected by the vehicle unit and indicating whether the user data device is inserted into a card slot included in the vehicle unit and adapted to receive a user data device;

if the data signal indicates that the user data device is inserted into the card slot of the vehicle unit, activating an ignition circuit of the vehicle to allow ignition of the vehicle); or if the data signal indicates that the user data device is not inserted into the card slot of the vehicle unit, deactivating an ignition circuit of the vehicle to prevent ignition of the vehicle; and if the data signal indicates that the user data device is not inserted into the card slot of the vehicle unit, in response to receiving an override signal, activating an ignition circuit of the vehicle to allow ignition of the vehicle, wherein the vehicle unit is capable of recording, digitally collecting, and storing vehicle data and activities of a user during operation of the vehicle, the vehicle unit further including a display, the ignition control apparatus is configured to be retrofitted into a vehicle, the ignition control apparatus comprises a microprocessor arranged to read data signals from the vehicle unit installed in the vehicle in order to control activating and deactivating an ignition circuit of the vehicle, and the ignition control apparatus is connected between the vehicle unit and the ignition circuit of the vehicle.

13. The method according to claim 12, wherein the override signal is included in the data signal received from the vehicle unit and includes a predetermined sequence of activities initiated by the user and detected by the vehicle unit.

14. The method according to claim 12, wherein the override signal is received from an external device or external server.

15. The method according to claim 14, wherein the external server contains data relating to authorized user data devices, the method further comprising the steps:

communicating with the external server;

if the data signal indicates that the user data device is inserted into the card slot of the vehicle unit, verifying whether the inserted user data is authorized; and activating the ignition circuit to allow ignition of the vehicle only if the inserted user data device is verified to be authorized.

16. The method according to claim 15, wherein the data relating to authorized user data devices comprises an identifier and one or more of a time interval, route details, a list of locations, and type of vehicle associated with the user data device, and wherein the step of verification of the inserted user data device comprises comparing data received from the external server associated with the inserted user data device and corresponding data contained in the data signal obtained from the vehicle unit.

17. The method according to claim 15, further comprising the steps:

transmitting an unlocking signal defining a sequence of activities to be detected by the vehicle unit from the external server to an external device associated with the inserted user data device;

displaying the sequence of activities to be detected by the vehicle unit on the external device; and activating the ignition circuit to allow ignition of the vehicle only if the sequence of activities defined by the transmitted unlocking signal is detected by the vehicle unit.

* * * * *